United States Patent [19]

Itoh et al.

[11] 3,973,950

[45] Aug. 10, 1976

[54] LOW CARBON CALCIUM-SULFUR CONTAINING FREE-CUTTING STEEL

[75] Inventors: Tetsuro Itoh, Tohkai; Tetsuo Takahashi, Nagoya; Kiyoichi Yamano, Tohkai, all of Japan

[73] Assignee: Daido Seiko Kabushiki Kaisha, Nagoya, Japan

[22] Filed: Sept. 12, 1975

[21] Appl. No.: 612,946

[30] Foreign Application Priority Data

Sept. 17, 1974 Japan ..... 49-107326

[52] U.S. Cl. ..... 75/123 D; 75/123 AA; 74/123 A; 75/123 E; 75/123 F; 75/123 G; 75/123 N

[51] Int. Cl.[2] ..... C22C 38/60

[58] Field of Search ..... 75/123 D, 123 E, 123 G, 75/123 N, 123 A, 123 AA, 123 F

[56] References Cited

UNITED STATES PATENTS

| | | | |
|---|---|---|---|
| 2,484,231 | 10/1949 | Kent | 75/123 D |
| 3,723,103 | 3/1973 | Kato et al. | 75/123 F |
| 3,844,773 | 10/1974 | Yamakoshi et al. | 75/123 G |

FOREIGN PATENTS OR APPLICATIONS

| | | | |
|---|---|---|---|
| 1,270,646 | 4/1972 | United Kingdom | 75/123 N |

*Primary Examiner*—Arthur J. Steiner

[57] ABSTRACT

Low carbon calcium-sulfur containing free-cutting steel exhibiting improved machinability is disclosed. The said steel consists essentially of 0.03 to 0.10% carbon, up to 0.3% silicon, 0.8 to 1.5% manganese, 0.04 to 0.10% phosphorus, 0.20 to 0.45% sulfur, 0.0003 to 0.0050% calcium and the remainder being iron and inherent impurities such as copper, nickel, chromium and nitrogen; and is prepared by regulating the composition of the steel so that the value of theoretical Brinell hardness of the steel matrix, which is determined on the basis of the content of carbon, silicon, manganese, phosphorus, sulfur, copper, nickel, chromium and nitrogen in the steel, to a value between 110 and 130, and by forming and maintaining in the range of from 100 to 500 grams per steel-ton oxide inclusions of type JIS-A2 (ASTM-C) which soften or fuse at a temperature not higher than 1400°C.

16 Claims, 5 Drawing Figures

TURNING CONDITIONS

| | |
|---|---|
| MATERIAL OF TOOL | : HIGH SPEED STEEL (JIS SKH57) |
| SHAPE OF TOOL | : 0, 15, 7, 7, 10, 0, 0.5R |
| CUTTING SPEED | : 150 m/min |
| FEEDING RATE | : 0.12 mm/rev |
| DEPTH OF CUT | : 1.0 mm |
| CUTTING FLUID | : SPINDLE OIL |
| CRITERION OF TOOL SERVICE LIFE | : TOOL FAILURE |

FIG. 1

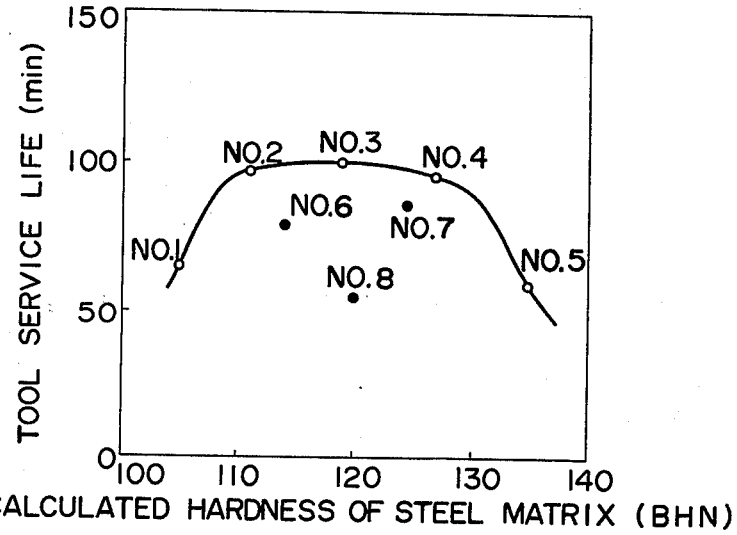

TURNING CONDITIONS

| | |
|---|---|
| MATERIAL OF TOOL | : CEMENTED CARBIDE (JIS P20) |
| SHAPE OF TOOL | : 0, 6, 6, 6, 10, 0, 0.5R, |
| CUTTING SPEED | : 150 m/min |
| FEEDING RATE | : 0.12 mm/rev |
| DEPTH OF CUT | : 1.0 mm |
| CUTTING FLUID | : DRY |
| CRITERION OF TOOL SERVICE LIFE | : FLANK WEAR $V_3$ = 0.1 mm |

FIG. 2

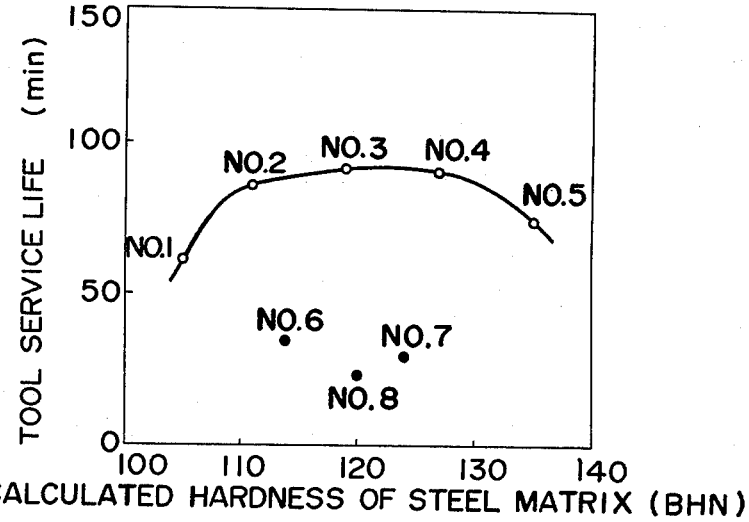

TOOL : HIGH SPEED STEEL SKH 9 10mm DIA. STRAIGHT SHARK DRILE
CUTTING SPEED : 47 m/min
FEEDING RATE : 0.42 mm/rev
DEPTH OF HOLE : 40 mm
CUTTING FLUID : DRY TOOL : CEMENTED CARBIDE P20 10mm DIA. STRAIGHT SHARK DRILE
CUTTING SPEED : 47 m/min
FEEDING RATE : 0.42 mm/rev
DEPTH OF HOLE : 40 mm
CUTTING FLUID : DRY

LOW CARBON CALCIUM-SULFUR CONTAINING FREE-CUTTING STEEL

BACKGROUND OF THE INVENTION

1. Field of the Invention

The present invention concerns a free-cutting steel. More particularly, it concerns a low carbon calciumsulfur containing free-cutting steel exhibiting improved machinability prepared by regulating the Brinell hardness of the steel matrix to a selected suitable range and by forming and maintaining a suitable amount of oxide inclusions of type JIS-A2 (ASTM-C) which soften or fuse at a temperature not higher than 1400°C in the steel. Drawbacks of conventional killed low-carbon manganese sulfide containing free-cutting steel are remedied in the present steel.

2. Description of the Prior Art

It has been common to use low-carbon sulfur containing free-cutting steel exhibiting improved machinability, in which soft-sulfide inclusions in the form of MnS are dispersed. Tool service life is extended when the steel is cut with a high speed steel tool, because the sulfide inclusions bring about effects such as promotion of strain by concentrated stress in the contact area of the tool and the cut material, or crack propagation, decrease of tool wear through internal lubrication, and prevention of built up edge formation. However, if there exist in the steel oxide or carbonitride inclusions, e.g. $SiO_2$, $Al_2O_3$, TiO, Ti(CN), having hardness higher than that of the tool material among the inclusions which are inevitably contained in the steel due to formation of deoxidation products or addition of alloying elements during deoxidation treatment of molter steel, these inclusions act like fine abrasive grains to abrade and damage the tool resulting in decrease of the tool service life.

Thus, low-carbon sulfur containing free-cutting steels generally made nowadays are so-called Mn-S killed steels which have not been subjected to a strong deoxidation so as to keep the content of the hard inclusion low. In the Mn-S killed low-carbon sulfur containing free-cutting steel, bubble formation in the surface layer of the ingot is unavoidable because generation of carbon monoxide gas during solidification of the ingot, even though rimming action and the generation of CO gas are surpressed at higher contents of manganese and sulfur. The bubbles, which are defects of the billet surface further increase billet surface conditioning time and cause decrease in yield. Moreover, insufficient deoxidation results in serious sulfur segregation, and hence, machinability and mechanical properties vary significantly from ingot to ingot.

SUMMARY OF THE INVENTION

Accordingly, an object of the present invention is to provide a low carbon sulfur containing free-cutting steel exhibiting improved machinability when cut with a high speed steel tool.

Another object of the present invention is to provide a free-cutting steel in which the problems of the conventional Mn-S killed low-carbon sulfur containing free-cutting steel are solved.

These and other objects can be achieved in accordance with the present invention by selecting steel composition so as to obtain specific hardness of the steel matrix and by turning the hard oxide inclusions, which have been harmful to cutting with high speed steel tool, into soft and harmless inclusions. The softened oxide inclusions may also be utilized effectively for cutting with a cemented carbide tool.

BRIEF EXPLANATION OF THE DRAWINGS

The criticality of the features and the merits of the present invention will be better understood by reference to the attached drawings:

FIG. 1 and FIG. 2 are plots of the relation between tool service life and hardness of steel matrix.

DETAILED DESCRIPTION OF THE PREFERRED EMBODIMENTS

Figure 3:
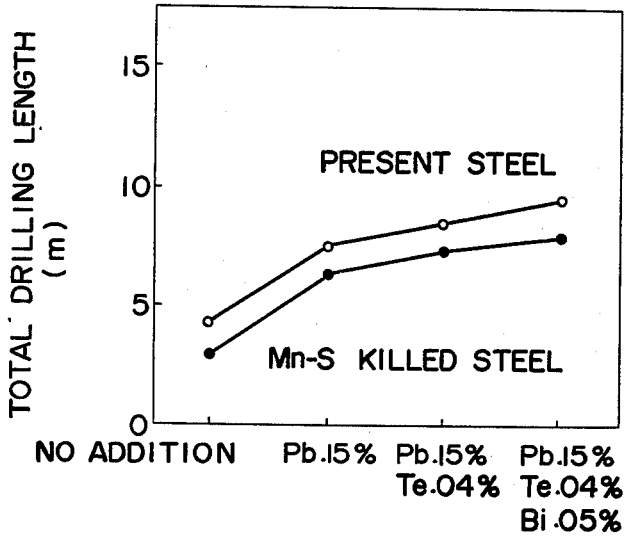
FIG. 3 and FIG. 4 show drillability of the present steel compared with those of the conventional steels.

The low-carbon calcium-sulfur containing free-cutting steel exhibiting improved machinability consists of 0.03 to 0.10% carbon, up to 0.3% silicon, 0.8 to 1.5% manganese, 0.04 to 0.10% phosphorus, 0.20 to 0.45% sulfur, 0.0003 to 0.0050% calcium, 0 to 0.25% lead, 0 to 0.10% telurium, 0 to 0.15% bismuth, 0 to 0.2% tin, 0 to 0.2% zinc, 0 to 0.2% arsenic, 0 to 0.2% thallium the remainder being iron and impurities; and may contain copper, nickel, chromium and nitrogen as impurities. Contents of carbon, silicon, manganese, phosphorus, sulfur, copper, nickel, chronium and nitrogen are regulated within the above ranges so that the value of theoretical Brinell hardness (BHN) of the steel matrix defined by the formula:

$$BHN = 70 + 230[\%C] + 500[\%N] + 112[\%P] + 33[\%Si] + 23[\%Mn] + 8[\%Ni] + 8[\%Cu] + 7[\%Cr] - 39[\%S]$$

falls in the range of 110 to 130. Further, the said steel contains in the range from 100 to 450 grams per steel-ton. of oxide inclusions principally of type JIS-A2 (ASTM-C) which soften or fuse at a temperature not higher than 1400°C.

In the preferred embodiments of the invention, the said steel contains 0.25 to 0.45% of sulfur and 0.0003 to 0.0030% of calcium. The steel of the most preferred embodiments contains 0.25 to 0.40% of sulfur, 0.0010 to 0.0020% of calcium, and 200 to 400 gram per ton-steel of the said oxide inclusions.

The most important point of the present invention is the improvement of machinability of the steel through formation of soft, amorphous oxide inclusions. For this purpose aluminum content in the steel should be maintained as low as possible by using Ca-Si deoxidizing alloy or ferromanganese, aluminum content of which is reduced to a level less than one third of the conventional amount, so as to form oxide inclusions principally of type JIS - A2 (ASTM-C), wich soften or fuse at a temperature not higher than 1400°C, finely and uniformly dispersed in the steel. When deoxidation of the steel is performed with calcium and silicon, oxygen content in the molten steel becomes extremely low, and as a result, surface defects due to bubble formation on the ingot surface may be much reduced and the yild of the steel will be improved. Therefore, strong deoxidation surpresses segregation of sulfur and reduces to variation in machinability and mechanical properties.

When the steel is cut at a high cutting speed with a cemented carbide tool, which has a low thermal conductivity, the temperature at the tool tip exceeds 1000°C. Thus, the soft oxide inclusions such as type JIS-A2 (ASTM-C) contained in the steel soften or fuse and deposit on the cutting surface of the tool. The deposited oxide prevents direct contact between the tool and cutting chip to decrease wearing of the tool resulting in remarkable extension of service life of the cemented carbide tool.

Experimental results show that an oxide inclusion of at least 100 g per steel-ton are necessary to improve machinability obtained in the conventional sulfur containing free-cutting steel. A content of more than 500 g/steel ton causes decreased yield due to surface defects of the ingots. Preferred range of the oxide inclusion content is from 200 to 400 g per steel-ton.

In the production of low carbon sulfur containing free-cutting steel, it is difficult to completely remove in usual oxidation refining copper, nickel, chromium and nitrogen, which are often present in such raw materials as scrap, and hence, the content thereof varies largely from batch to batch. Hardness of the steel matrix depends on contents of these impurity elements which affect machinability and mechanical properties of the steel. From comparative study of the theoretical Brinell hardness (BHN) of steel matrix calculated on the basis of contents of alloying elements and impurity elements with results of cutting tests, it has been found that, though somewhat affected by the testing conditions, the best machinability can be obtained when the BHN falls in the range between 110 and 130. According to the present invention hardness of the steel matrix is maintained in the most suitable range for machinability, even if the above mentioned impurities should find their way into the steel, by regulating the content of the alloying elements such as carbon, silicon, manganese and phosphor. Also, it has been confirmed that the BHN observed for the steel may not be a criterion because it depends on the state of the steel after such processing as rolling, annealing and drawing.

The theoretical BHN which is the criterion is defined by the following formula:

$$BHN = 70 + 230[\%C] + 560[\%N] + 112[\%P] + 33[\%Si] + 23[\%Mn] + 8[\%Ni] + 8[\%Cu] + 7[\%Cr] - 39[\%S]$$

Thus, the formdamental low-carbon calcium-sulfur containing free-cutting steel of the present invention exhibiting improved machinability to turning machines consists of 0.03 to 0.10% carbon, up to 0.3% silicon, 0.8 to 1.5% manganese, 0.04 to 0.10% phosphorus, 0.20 to 0.45% sulfur, 0.0003 to 0.0050% calcium and the remainder being iron and impurities, and may contain copper, nickel, chromium or nitrogen as impurities. The theoretical BHN of the steel matrix defined by the above mentioned formula is regulated by selecting the composition to be in the range of 110 to 130, and the steel contains oxide inclusions of type JIS-A2 (ASTM-C) which soften or fuse at a temperature not higher than 1400°C in an amount ranging from 100 to 500 g per steel-ton.

The significance of the above mentioned ranges of the essential components are as follows:

Carbon: 0.03 to 0.10%

To obtain proper strength of the steel at least 0.03% carbon is necessary. More than 0.10% carbon makes the steel too hard.

Silicon: up to 0.30%

Silicon is used as a deoxidizer and a carrier of calcium. Upper limit of the content is 0.30%.

Manganese: 0.8 to 1.5%

Manganese forms MnS with sulfur to maintain hot workability and to increase the strength of the steel. However, too much addition affects machinability. Weight ratio of Mn and S, which gives the best balance of hot workability, steel strength and machinability, is about 1 to 3. In view of this fact, the content of manganese is selected to be 0.8 to 1.5%.

Phosphorus: 0.04 to 0.10%.

Phosphorus is added to improve machinability of steel, particularly to decrease roughness of finished surface due to embrittlement effect thereof in an amount of 0.04% or more. If too much phosphorus is added, the steel becomes too hard. The upper limit is 0.10%.

Sulfur: 0.20 to 0.45%

Sulfur is added to improve machinability. Preferable range is from 0.25 to 0.40%.

Calcium: 0.0003 to 0.0050%

Calcium is added to molten steel in the form of a calcium-containing alloy such as Ca-Si. Calcium content necessary to improve machinability of the steel is at least 0.0003%, preferably 0.0010%. However, excess addition of calcium gives oxide inclusions of high CaO content which are not of type JUS-A2(ASTM-C) and is ineffective in improving machinability. This is due to increase of aluminum content in the steel, which comes from the added Ca-Si alloy as an impurity thereof, and results in decrease of oxide inclusions of type JIS-A2(ASTM-C). Thus upper limit of calcium content is 0.0050%, preferably 0.0020%.

As noted above, tool service life of a turning machine is improved by the strong oxidation, formation of soft oxide inclusions of type JIS-A2 (ASTM-C) and regulation of steel matrix hardness. However, improvement in drillability and decrease of roughness of finished surface of the steel still remains insufficient, and methods usable for machining the steel are limited. Addition of at least one of lead, telurium and bismuth has been found effective for the purpose of further improving drillability of the present steel.

Also, addition of at least one of tin, zinc, arsenic and thallium has been found effective for the purpose of further decreasing finished surface roughness of the present steel.

As preferred embodiment of the invention, the low-carbon calcium-sulfur containing free-cutting steel exhibiting improved machinability and drillability consists of 0.03 to 0.10% carbon, up to 0.3% silicon, 0.8 to 1.5% manganese, 0.04 to 0.10% phosphorus, 0.20 to 0.45% sulfur, 0.0003 to 0.0050% calcium, and at least one of 0.05 to 0.25% lead, 0.02 to 0.10% telurium, and 0.02 to 0.15% bismuth in total amount of 0.25% or less, and the remainder being iron and impurities, and may contain copper, nickel, chromium or nitrogen as impurities. The theoretical BHN of the steel matrix defined by the above mentioned formula is regulated by selecting the composition to be in the range of 110 to 130, and the steel contains soft oxide inclusions of the type JIS-A2 (ASTM-C) in an amount ranging from 100 to 500 grams per steel-ton.

Addition of at least one of lead, telurium, and bismuth in an amount above the lower limits improves drillability of the foundamental steel of the present invention. When two or three of these elements are added jointly, the total amount should be limited to 0.25% or less so that the steel strength and hot workability will not be affected by excessive addition.

As another preferred embodiment, the low-carbon calcium-sulfur containing free-cutting steel exhibiting improved machinability and decreased finished surface roughness consists of 0.03 to 0.10% carbon, up to 0.3% silicon, 0.8 to 1.5% manganese, 0.04 to 0.10% phosphorus, 0.20 to 0.45% sulfur, 0.0003 to 0.0050% calcium, and at least one of 0.05 to 0.2% tin, 0.05 to 0.2% zinc, 0.05 to 0.2% arsenic and 0.05 to 0.2% thallium, in total amount of 0.25% or less, and the remainder being iron and impurities, and may contain copper, nickel, chromium or nitrogen as impurities. The theoretical BHN of the matrix steel defined by the above mentioned formula is regulated by selecting the composition to be in the range of 110 to 130, and the steel contains soft oxide inclusions of type JIS-A2 (ASTM-C) in an amount ranging from 100 to 500 grams per steel-ton.

Excessive addition of these elements causes decrease of steel strength and increase of cost. So, in case of joint addition, the total amount should be 0.25% or less.

Consolidation of the above mentioned preferred embodiments is also recommendable. In this preferred embodiment, the foundamental steel composition is added with at least one of the elements for improving drillability i.e. lead, telurium and bismuth and at least one of the elements for decreasing finished surface roughness, i.e. tin, zinc, arsenic and thallium in the respective amounts mentioned above.

The following examples are given not for limitation but for illustration of the present invention.

EXAMPLE 1

Steels of the present invention and steels for comparison including low-carbon MnS killed steels and a Si-Al killed steel were prepared in a 250 kg high-frequency induction furnace. After hot rolling to form rods of 60 mm diameter, the rods were annealed.

Table 1 shows the chemical compositions of the steels and the theoretical Brinell hardness BHN calculated by the above described formula. The low-carbon calcium-sulfur containing free-cutting steels of sample No. 1 to No. 5 were made through deoxidation using Ca-Si alloy containing aluminum impurity in a lower content than commercially available Ca-Si. The formed oxide inclusions were determined to be of type JIS-A2(ASTM-C) which fuse at a temperature not higher than 1400°C and are easily elongated during hot rolling.

The sample rods were tested by subjecting them to turning along the axis thereof with a high speed steel tool (JIS SKH 57) and a cemented carbide tool (JIS P20). Cutting speed: 150 m/min.; feeding rate: 0.12 mm/rev.; depth of cut: 1.0 mm. The cutting with the high speed steel tool was carried out using spindle oil as a cutting fluid; and the cutting with the cemented carbide tool was of dry type.

Table 1

| Sample No. | Chemical Composition (wt %) | | | | | | | | | | | Oxide Inclusions | | | Calculated Brinell Hardness in steel matrix (BHN) | Note |
|---|---|---|---|---|---|---|---|---|---|---|---|---|---|---|---|---|
| | C | Si | Mn | P | S | Cu | Ni | Cr | N | Ca | Al | Type | Content | Fusing temp. | | |
| 1 | 0.03 | 0.10 | 1.10 | 0.045 | 0.33 | 0.04 | 0.02 | 0.08 | 0.007 | 0.0009 | 0.001 | A2(C) | 360$^{gt}$ | 1250°C | 103 | Reference Steel |
| 2 | 0.04 | 0.15 | 1.01 | 0.064 | 0.33 | 0.20 | 0.15 | 0.22 | 0.008 | 0.0015 | 0.001 | A2(C) | 332 | 1280 | 111 | Steel of Present Invention |
| 3 | 0.05 | 0.17 | 1.15 | 0.063 | 0.34 | 0.15 | 0.19 | 0.18 | 0.013 | 0.0011 | 0.001 | A2(C) | 305 | 1270 | 119 | |
| 4 | 0.08 | 0.20 | 1.27 | 0.072 | 0.31 | 0.10 | 0.08 | 0.10 | 0.005 | 0.0023 | 0.001 | A2(C) | 260 | 1340 | 125 | |
| 5 | 0.09 | 0.15 | 1.28 | 0.095 | 0.30 | 0.11 | 0.12 | 0.16 | 0.015 | 0.0014 | 0.001 | A2(C) | 210 | 1310 | 135 | Reference Steel |
| 6 | 0.07 | 0.01 | 1.03 | 0.065 | 0.33 | 0.20 | 0.14 | 0.19 | 0.010 | tr | tr | — | 510 | <1650 | 114 | Mn—S Killed Steel |
| 7 | 0.09 | <0.01 | 1.20 | 0.063 | 0.31 | 0.15 | 0.19 | 0.21 | 0.013 | tr | tr | — | 480 | <1650 | 125 | |
| 8 | 0.07 | 0.15 | 1.10 | 0.067 | 0.29 | 0.14 | 0.16 | 0.11 | 0.006 | tr | 0.020 | B(B) | 170 | <2000 | 119 | Si—Al Killed Steel |

The types of the oxide inclusions are indicated by JIS notation (and ASTM in the parentheses).

FIG. 1 and FIG. 2 are the plots of the tool service lives in relation to the calculated hardness BHN by the above formula.

As seen from FIG. 1 service lives of the high speed steel tools observed are superior in the case where the calculated hardnesses of the steels matrix fall in the range from 110 to 130 to those in the case where the BHN is outside the range. Machinability of the present steels is better than that of the conventional Mn-S killed steels, and much better than that of the Al-Si killed steel.

Also, as seen from FIG. 2, service life of the cemented carbide tools are superior in the case where the calculated hardnesses of the steel matrix are in the above range to those in the case where the hardnesses are outside the range. Moreover, it is clear that the service life of the cemented carbide tools are much longer with the present steel than with the conventional steels having matrix hardnesses of the same level as the present steel.

EXAMPLE 2

This example shows the fact that drillability of the fundamental steel of the present invention (A-1) is improved by addition of at least one element of lead, telurium and bismuth. This effect may be attributable to the fact that these elements form metallic inclusions which act as stress concentration sources during drilling.

In view of the experimental results, a steel, the matrix hardness (BHN) of which was about 120 was prepared in a 250 kg high-frequency induction furnace. The molten steel was deoxidized with Ca-Si alloy of low aluminum content to form low temperature fusible oxide inclusions of type JIS-A2. Then, divisional casting gave the ingots of:

1. a steel consisting of fundamental elements,
2. a steel added with 0.15% lead,
3. a steel added with 0.15% lead and 0.04% telurium,
4. a steel added with 0.14% lead, 0.04% telurium and 0.05% bismuth.

Through hot rolling normalizing of the ingots, samples of 60 mm square section were made. In the same manner, Mn-S killed steels for comparison were also processed to give samples.

Table 2 shows chemical compositions, forms of the oxide inclusions and calculated matrix hardnesses of the steels.

Table 2

| Sample No. | Chemical Composition (wt%) C | Si | Mn | P | S | Cu | Ni | Cr | N | Ca | Pb | Te | Bi | Oxide Inclusions Type | Content | Fusing temp. | Note |
|---|---|---|---|---|---|---|---|---|---|---|---|---|---|---|---|---|---|
| A-1 | | | | | | | | | | | — | — | — | A2(C) | | | Present Steel Calculated Brinell Hardness of A-1 : 121 |
| A-2 | | | | | | | | | | | 0.15 | — | — | A2(C) | | | |
| | 0.07 | 0.16 | 1.13 | 0.066 | 0.33 | 0.14 | 0.15 | 0.14 | 0.010 | 0.0021 | | | | | 280$^{alt}$ | 1320°C | |
| A-3 | | | | | | | | | | | 0.15 | 0.04 | — | A2(C) | | | |
| A-4 | | | | | | | | | | | 0.14 | 0.04 | 0.05 | A2(C) | | | |
| B-1 | | | | | | | | | | | — | — | — | — | | | Mn-S Killed Steel Calculated Brinell Hardness of B-1 : 121 |
| B-2 | | | | | | | | | | | 0.15 | — | — | — | | | |
| | 0.07 | 0.02 | 1.20 | 0.070 | 0.31 | 0.13 | 0.16 | 0.15 | 0.013 | — | | | | | 490 | >1650 | |
| B-3 | | | | | | | | | | | 0.15 | 0.04 | — | — | | | |
| B-4 | | | | | | | | | | | 0.15 | 0.04 | 0.05 | — | | | |

The types of the oxide inclusions are indicated by JIS notation (and ASTM in the parentheses).

The samples were subjected to drilling test using a high speed steel drill (JIS SKH9) or a cemented carbide drill (JIS p10) of 10 mm diameter. Drilling condtions were as follows: cutting speed: 47 m/min., feeding rate; 0.42 mm/rev.; depth of drilled hole: 40 mm; drytype.

Criterion of tool service life of the high speed steel total drilling tools in this example was length until the tool became usuable. Drillability of the steels when drilled with a cemented carbide tool was expressed by extent of wearing, i.e. the reciprocals of ratios of the wearing with the sample of the fundamental steel of the present invention (A-1) to the wearing with the other samples; the former being taken as reference, 100.

Figure 4:
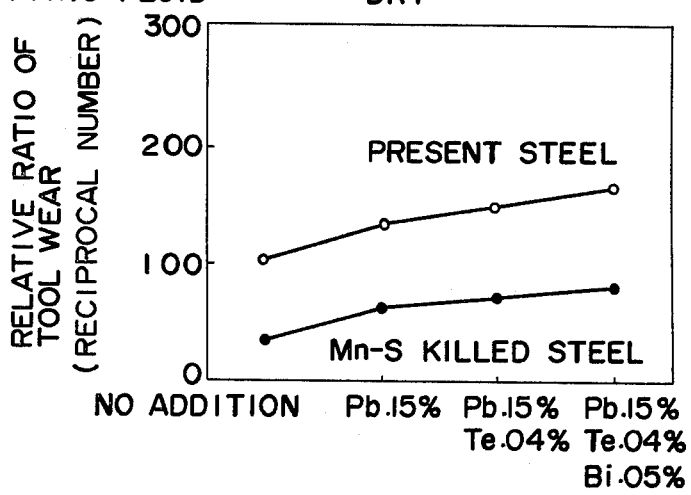

The results of the drilling tests are given in FIG. 3 and FIG. 4, which show the fact that drillability is improved by addition of one or more of lead, telurium and bismuth.

EXAMPLE 3

Two elements selected from tin, zinc, arsenic and talium were added to the steel having approximately the same fundamental composition shown in Table 2. Samples were made in the same manner, and planed on their one surfaces with a planer. Table 3 shows the observed finished surface roughnesses upon cutting with a milling machine as well as the steel compositions, forms of the oxide in inclusions and hardness of the steel-matrix.

Table 3

| Sample No. | Chemical Composition (wt %) C | Si | Mn | P | S | Cu | Ni | Cr | N | Ca | Sn | Zn | As | Tl |
|---|---|---|---|---|---|---|---|---|---|---|---|---|---|---|
| C-1 | | | | | | | | | | | — | — | — | — |
| C-2 | | | | | | | | | | | 0.15 | 0.05 | — | — |
| | 0.07 | 0.16 | 1.11 | 0.067 | 0.33 | 0.13 | 0.14 | 0.14 | 0.010 | 0.0019 | | | | |
| C-3 | | | | | | | | | | | | 0.04 | 0.11 | — |
| C-4 | | | | | | | | | | | | | 0.10 | 0.11 |
| Reference | 0.07 | 0.01 | 1.21 | 0.070 | 0.31 | 0.13 | 0.15 | 0.15 | 0.012 | — | — | — | — | — |

| Sample No. | Oxide Inclusions Type | Content | Fusing temp. | Calculated Brinell Hardness in steel matrix (BHN) | Relative Roughness of Finished Surface |
|---|---|---|---|---|---|
| C-1 | A2(C) | | | | 100 |
| C-2 | A2(C) | | | | 84 |
| | | 300$^{alt}$ | 1330°C | 120 | |
| C-3 | A2(C) | | | | 85 |
| C-4 | A2(C) | | | | 77 |
| Reference | — | 480 | <1650 | 120 | 98 |

The types of the oxide inclusions are indicated by JIS notation (and ASTM in the parentheses).

The data observed proves that the surface roughness of the fundamental steel of the present invention (C-1) is decreased by the addition of tin, zinc, aresenic or talium.

EXAMPLE 4

A steel of the present invention having a similar composition to Sample No. 3 of Example 1 was cast into a 2.5 ton ingot. The ingot was examined for the occurance of surface defects and variation of mechanical property due to sulfur seggregation. The results are shown in FIG. 5 and Table 4 in comparison with the results with a conventional Mn-S killed steel having a similar composition to Sample No. 6 of Example 1.

Figure 5:
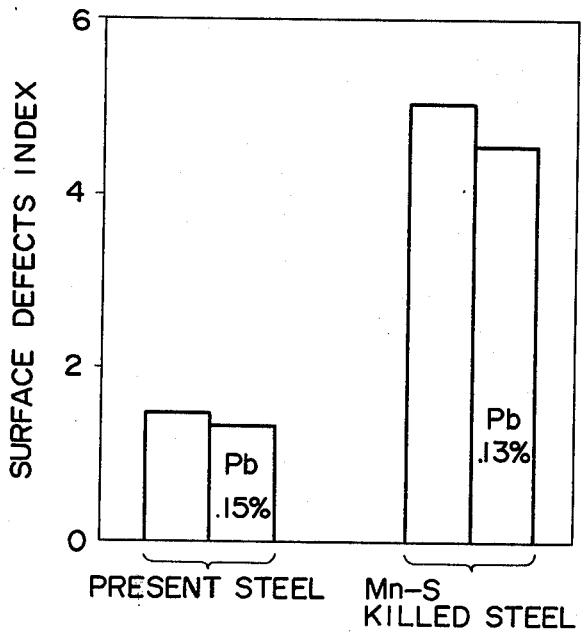
FIG. 5 illustrates surface defect index of the present steel and the conventional steel.

FIG. 5 illustrates surface defect index of the present steel and the conventional steel. The steel of the present invention has less surface defects and corner crackings, which reduces surfaces conditioning time of the ingot.

Table 4 shows variation in machinability and mechanical property of the samples cut off from the tops of the present steel and the conventional Mn-S killed steel ingots. The present steel exhibits less variation in machinability and mechanical property.

Table 4

| | Service of life high speed steel turning tools | | | Mechanical Property (reduction of area) | | |
|---|---|---|---|---|---|---|
| | Surface | Intermediate | Center | Surface | Intermediate | Center |
| Present Steel | 104 | 102 | 100 | 57 | 56 | 56 |
| Reference Steel | 81 | 73 | 65 | 57 | 55 | 48 |

We claim:

1. A low-carbon calcium-sulfur containing free-cutting steel, which consists essentially of 0.03 to 0.10% carbon, up to 0.3% silicon, 0.8 to 1.5% manganese, 0.04 to 0.10% phosphorus, 0.20 to 0.45% sulfur, and 0.0003 to 0.0050% calcium, 0 to 0.25% lead, 0 to 0.10% telurium, 0 to 0.15% bismuth, 0 to 0.2% tin, 0 to 0.2% zinc, 0 to 0.2% arsenic, 0 to 0.2% thallium, and the remainder being iron and impurities; and which may contain copper, nickel chromium and nitrogen as impurities; wherein the content of carbon, silicon, manganese, phosphorus, sulfur, copper, nickel, chromium and nitrogen is regulated within the above ranges so that the value of theoretical Brinell hardness (BHN) of the steel matrix defined by the formula:

$$BHN = 70 + 230[\%C] + 560[\%N] + 112[\%P] + 33[\%Si] + 23[\%Mn] + 8[\%Ni] + 8[\%Cu] + 7[\%Cr] - 39[\%S]$$

falls in the range of 110 to 130; and, wherein the said steel contains in the range of from 100 to 500 grams per steel-ton of oxide inclusions principally of type JIS -A2 (ASTM-C) softening or fusing at a temperature not higher than 1400°C.

2. A low-carbon calcium-sulfur containing free-cutting steel according to claim 1, wherein the content of sulfur is 0.25 to 0.45% and the content of calcium 0.0003 to 0.0030%.

3. A low-carbon calcium-sulfur containing free-cutting steel according to claim 1, wherein the content of sulfur is 0.25 to 0.4%, the content of calcium 0.0003 to 0.0020%, and the content of the oxide inclusion in the range of from 200 to 400 grams per steel-ton.

4. A low-carbon calcium-sulfur containing free-cutting steel, which consists essentially of 0.03 to 0.10% carbon, up to 0.3% silicon, 0.8 to 1.5% manganese, 0.04 to 0.10% phosphorus, 0.20 to 0.45% sulfur, 0.0003 to 0.0050% calcium, and the remainder being iron and impurities; and which may contain copper, nickel, chromium and nitrogen as impurities; wherein the content of carbon, silicon, manganese, phosphorus, sulfur, copper, nickel, chromium and nitrogen is regulated within the above ranges so that the value of theoretical Brinell hardness (BHN) in the steel matrix defined by the formula:

$$BHN = 70 + 230[\%C] + 560[\%N] + 112[\%P] + 33[\%Si] + 23[\%Mn] + 8[\%Ni] + 8[\%Cu] + 7[\%Cr] - 39[\%S]$$

falls in the range of 110 to 130; and wherein the said steel contains in the range of from 100 to 500 grams per steel-ton of oxide inclusions principally of type JIS-A2 (ASTM-C) softening or fusing at a temperature not higher than 1400°C.

5. A low-carbon calcium-sulfur containing free-cutting steel according to claim 4, wherein the content of sulfur is 0.25 to 0.45% and the content of calcium 0.0003 to 0.0030%.

6. A low-carbon calcium-sulfur containing free-cutting steel according to claim 4, wherein the content of sulfur is 0.25 to 0.40%, the content of calcium 0.0010 to 0.0020%, and the content of the oxide inclusions in the range of from 200 to 400 grams per steel-ton.

7. A low-carbon calcium-sulfur containing free-cutting steel, which consists essentially of 0.03 to 0.10% carbon, up to 0.3% silicon, 0.8 to 1.5% manganese, 0.04 to 0.10% phosphorus, 0.20 to 0.45% sulfur, 0.0003 to 0.0050% calcium and at least one of 0.05 to 0.25% lead, 0.02 to 0.10% telurium and 0.02 to 0.15% bismuth (total amount of Pb, Te and Bi being up to 0.25%), the remainder being iron and impurities; and which may contain copper, nickel, chromium and nitrogen as impurities; wherein the content of carbon, silicon, manganese, phosphorus, sulfur, copper, nickel, chromium and nitrogen is regulated within the above ranges so that the value of theoretical Brinell hardness (BHN) in the steel matrix defined by the formula:

$$BHN = 70 + 230[\%C] + 560[\%N] + 112[\%P] + 33[\%Si] + 23[\%Mn] + 8[\%Ni] + 8[\%Cu] + 7[\%Cr] - 39[\%S]$$

falls in the range of 110 to 130; and wherein the said steel contains in the range of from 100 to 500 grams per steel-ton of oxide inclusions principally of type JIS-A2 (ASTM-C) softening or fusing at a temperature not higher than 1400°C.

8. A low-carbon calcium-sulfur containing free-cutting steel according to claim 7, wherein the content of sulfur is 0.25 to 0.45% and the content of calcium 0.0003 to 0.0030%.

9. A low-carbon calcium-sulfur containing free-cutting steel according to claim 7, wherein the content of sulfur is 0.25 to 0.40%, the content of calcium 0.0010 to 0.0020%, and the content of the oxide inclusions in the range of from 200 to 400 grams per steel-ton.

10. A low-carbon calcium-sulfur containing free-cutting steel which consists essentially of 0.03 to 0.10 carbon, up to 0.3% silicon, 0.8 to 1.5% manganese, 0.04 to 0.10% phosphorus, 0.20 to 0.45% sulfur, 0.0003 to 0.0050% calcium, at least one of 0.05 to 0.2% tin, 0.05 to 0.2% zinc, 0.05 to 0.2% arsenic and 0.05 to 0.2% thallium (total amount of Sn, Z, As and Tl; being up tp 0.25%), the remainder being iron and impurities; and which may contain copper, nickel, chromium and nitrogen as impurities; wherein content of carbon, silicon, manganese, phosphorus, sulfur, copper, nickel, chromium and nitrogen is regulated within the above ranges so that the value of theoretical Brinell hardness (BHN) in the steel matrix defined by the formula:

$$BHN = 70 + 230[\%C] + 560[\%N] + 112[\%P] + 33[\%Si] + 23[\%Mn] + 8[\%Ni] + 8[\%Cu] + 7[\%Cr] - 39[\%S]$$

falls in the range of 110 to 130; and wherein the said steel contains in the range of from 100 to 500 grams per steel-ton of oxide inclusions principally of type JIS-A2 (ASTM-C) softening or fusing at a temperature not higher than 1400°C.

11. A low-carbon calcium-sulfur containing free-cutting steel according to claim 10, wherein the content of sulfur is 0.25 to 0.45% and the content of calcium 0.0003 to 0.0030%.

12. A low-carbon calcium-sulfur containing free-cutting steel according to claim 10, wherein the content of sulfur is 0.25 to 0.40%, the content of calcium 0.0010 to 0.0020%, and the content of the oxide inclusions from 200 to 400 grams per steel-ton.

13. A low-carbon calcium-sulfur containing free-cutting steel which consists essentially of 0.03 to 0.10% carbon, up to 0.3% silicon, 0.8 to 1.5% manganese, 0.04 to 0.10% phosphorus, 0.20 to 0.45% sulfur, 0.0003 to 0.0050% calcium, and at least one of 0.05 to 0.25% lead, 0.02 to 0.10% telurium and 0.02 to 0.15% bismuth (total amount of Pb, Te and Bi: being up to 0.25%), and at least one of 0.05 to 0.2% tin, 0.05 to 0.2% zinc, 0.05 to 0.2% arsenic and 0.05 to 0.2% thallium (total amount of Sn, Zn, As and Tl: being up to 0.25%) and the remainder being iron and impurities; and which may contain copper, nickel, chromium and nitrogen as impurities; wherein content of carbon, silicon, manganese, phosphorus, sulfur, copper, nickel, chromium and nitrogen is regulated within the above ranges so that the value of theoretical Brinell hardness (BHN) defined by the formula:

$$BHN = 70 + 230[\%C] + 560[\%N] + 112[\%P] + 33[\%Si] + 23[\%Mn] + 8[\%Ni] + 8[\%Cu] + 7[\%Cr] - 39[\%S]$$

falls in the range of 110 to 130; and wherein the said steel contains in the range of 100 to 500 grams per steel-ton of oxide inclusions principally of type JIS-A2 (ASTM-C) softening or fusing at a temperature not higher than 1400°C.

14. A low-carbon calcium-sulfur containing free-cutting steel according to claim 13, wherein the content of sulfur is 0.25 to 0.45% and the content of calcium 0.0003 to 0.0030%.

15. A low-carbon calcium-sulfur containing free-cutting steel according to claim 13, wherein the content of sulfur is 0.25 to 0.45% and the content of calcium 0.0003 to 0.0030%.

16. A low-carbon calcium-sulfur containing free-cutting steel according to claim 13, wherein the content of sulfur is 0.25 to 0.40%, the content of calcium 0.0010 to 0.0020%, and the content of the oxide inclusions from 200 to 400 grams per steel-ton.

* * * * *